US010934804B2

(12) United States Patent
Rogers et al.

(10) Patent No.: US 10,934,804 B2
(45) Date of Patent: Mar. 2, 2021

(54) APPARATUS AND METHOD FOR CREATING A PLUG IN A WELLBORE

(71) Applicant: HALLIBURTON ENERGY SERVICES, INC., Houston, TX (US)

(72) Inventors: Henry Eugene Rogers, Oklahoma City, OK (US); Michael Malave, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 296 days.

(21) Appl. No.: 16/088,012

(22) PCT Filed: May 12, 2016

(86) PCT No.: PCT/US2016/032054
§ 371 (c)(1),
(2) Date: Sep. 24, 2018

(87) PCT Pub. No.: WO2017/196335
PCT Pub. Date: Nov. 16, 2017

(65) Prior Publication Data

US 2020/0291740 A1 Sep. 17, 2020

(51) Int. Cl.
*E21B 33/134* (2006.01)
*E21B 33/138* (2006.01)
*E21B 33/12* (2006.01)

(52) U.S. Cl.
CPC ..... *E21B 33/134* (2013.01); *E21B 33/12* (2013.01); *E21B 33/138* (2013.01)

(58) Field of Classification Search
CPC ..... E21B 33/134; E21B 33/12
See application file for complete search history.

(56) References Cited

U.S. PATENT DOCUMENTS

| | | | |
|---|---|---|---|
| 2,674,315 | A | 4/1954 | Brown |
| 2,836,252 | A | 5/1958 | Lane |
| 3,039,534 | A | 6/1962 | Koop |
| 3,131,767 | A | 5/1964 | Chancellor et al. |
| 3,570,603 | A | 3/1971 | Kammerer, Jr. et al. |
| 3,789,926 | A | 2/1974 | Henley et al. |
| 3,948,322 | A | 4/1976 | Baker |
| 4,066,125 | A | 1/1978 | Bassani |
| 4,287,948 | A | 9/1981 | Haggard |
| 4,407,369 | A | 10/1983 | Hutchison et al. |
| 4,431,058 | A | 2/1984 | Spencer et al. |
| 4,531,583 | A | 7/1985 | Revett |

(Continued)

FOREIGN PATENT DOCUMENTS

| | | | |
|---|---|---|---|
| EP | 1340882 | A2 | 9/2003 |
| WO | 2011107745 | A2 | 9/2011 |
| WO | 2011107745 | A3 | 9/2011 |

OTHER PUBLICATIONS

B J Services Company Brochure titled "Para-Bow Cementing Tool" (undated but admitted to be prior art).

(Continued)

*Primary Examiner* — Miachael R Wills, III
(74) *Attorney, Agent, or Firm* — McAfee & Taft

(57) ABSTRACT

A diversion and isolation tool is releasably connected to a workstring and lowered into a well. The diversion and isolation tool is movable in the well, and serves as a barrier to prevent fluids from mixing and is useful for plugging the well.

20 Claims, 9 Drawing Sheets

(56) References Cited

U.S. PATENT DOCUMENTS

| | | | |
|---|---|---|---|
| 4,665,978 | A | 5/1987 | Luke |
| 4,869,325 | A | 9/1989 | Halbardier |
| 4,961,465 | A | 10/1990 | Brandell |
| 5,117,910 | A | 6/1992 | Brandell et al. |
| 5,195,584 | A | 3/1993 | Basinger, Jr. |
| 5,295,279 | A | 3/1994 | Cooper |
| 5,318,118 | A | 6/1994 | Duell |
| 5,368,103 | A | 11/1994 | Heathman et al. |
| 5,566,757 | A | 10/1996 | Carpenter et al. |
| 5,579,843 | A | 12/1996 | Loitherstein |
| 5,667,015 | A | 9/1997 | Harestad et al. |
| 5,732,774 | A | 3/1998 | Haggard |
| 5,787,982 | A | 8/1998 | Bakke |
| 5,803,177 | A | 9/1998 | Hriscu et al. |
| 6,082,451 | A | 7/2000 | Giroux et al. |
| 6,082,459 | A | 7/2000 | Rogers et al. |
| 6,182,766 | B1 | 2/2001 | Rogers et al. |
| 6,454,001 | B1 | 9/2002 | Thompson et al. |
| 6,622,798 | B1 | 9/2003 | Rogers et al. |
| 6,772,835 | B2 | 8/2004 | Rogers et al. |
| 6,880,636 | B2 | 4/2005 | Rogers et al. |
| 7,004,248 | B2 | 2/2006 | Hoffman et al. |
| 7,152,674 | B2 | 12/2006 | Bowles |
| 7,472,752 | B2 | 1/2009 | Rogers et al. |
| 7,735,552 | B2 | 6/2010 | Xu |
| 8,739,873 | B2 | 6/2014 | Rogers et al. |
| 2002/0139539 | A1* | 10/2002 | Hoffman ..... E21B 23/06 166/381 |
| 2004/0149429 | A1 | 8/2004 | Dilber et al. |
| 2005/0087338 | A1 | 4/2005 | Parker |
| 2007/0261863 | A1 | 11/2007 | MacLeod et al. |
| 2008/0164029 | A1 | 7/2008 | Rogers et al. |
| 2009/0151960 | A1 | 6/2009 | Rogers et al. |
| 2010/0084141 | A1 | 4/2010 | Gazewood |
| 2010/0243277 | A1 | 9/2010 | Ring |
| 2010/0294503 | A1 | 11/2010 | Laurel et al. |
| 2011/0214861 | A1 | 9/2011 | Rogers et al. |
| 2013/0118752 | A1 | 5/2013 | Hannegan et al. |
| 2013/0319676 | A1 | 12/2013 | Themig |

OTHER PUBLICATIONS

Presentation of Kristian Harestad, Perigon, May 24, 2006, "Cement Support Tool (CST)".

Page from Perigon brochure titled, "Avoid cement plug support failure with Cement Support Tool" (undated but admitted to be prior art.

Page from Perigon brochure titled, "CST Running Procedure" (undated but admitted to be prior art).

International Preliminary Report on Patentability, PCT/GB/2011/000298, dated Sep. 11, 2012, 7 pages.

International Search Report and Written Opinion, PCT/GB2011/000298, dated Apr. 10, 2012, 10 pages.

International Search Report and Written Opinion issued in corresponding PCT Application No. PCT/US2016/032054, dated Feb. 10, 2017.

* cited by examiner

APPARATUS AND METHOD FOR CREATING A PLUG IN A WELLBORE

The present disclosure relates to systems and method of cementing a wellbore.

When drilling a wellbore that penetrates one or more subterranean earth formations, it may be advantageous or necessary to create a hardened plug in the borehole. Such plugs are used for abandonment of the well, wellbore isolation, wellbore stability, or kickoff procedures. There are a number of systems used to create the hardened plug.

For example, a cement plug may be set in a borehole by pumping a volume of spacer fluid compatible with the drilling mud and cement slurry into the workstring. Then, a predetermined volume of cement slurry is pumped behind the spacer fluid. The cement slurry travels down the workstring and exits into the wellbore to form a plug.

After the cement slurry has been pumped into the wellbore in sufficient quantities to form the plug, a portion of the workstring surrounded by cement, referred to as a sacrificial tail pipe is typically detached from the rest of the workstring and left in the wellbore. The disclosure below provides an additional apparatus and method capable of forming a cement plug in a wellbore.

BRIEF DESCRIPTION OF THE DRAWINGS

FIG. 6 is an exploded view of a fluid isolator assembly.

DETAILED DESCRIPTION

Figure 1:
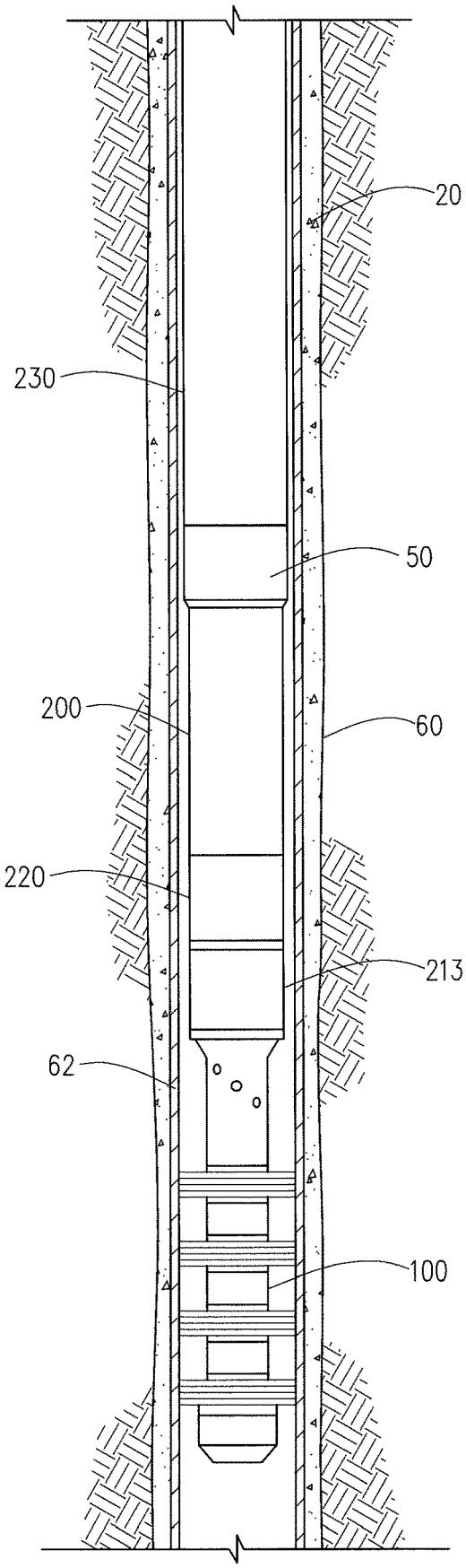
FIG. 1 is a schematic illustration of a downhole tool comprising a disconnect tool and a diversion and movable isolation tool positioned in a well.

In the drawings and description that follow, like parts are typically marked throughout the specification and drawings with the same reference numerals, respectively. Figures are not necessarily drawn to scale. Certain features of the apparatus or methods disclosed herein may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described unless specifically stated. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation.

The present disclosure provides a downhole tool comprising a diversion and movable isolation tool ("DMIT") and disconnect tool, useful for, among other things, creating a cement plug in an open or cased well. In the present disclosure, the structure of the DMIT and disconnect tool are first described in detail. Next, the manner in which the disconnect tool disconnects from a workstring is described in detail. Finally, a method of using the DMIT and the disconnect tool to create a cement plug are described in detail.

Referring now to FIG. 1, an apparatus or downhole tool 50 comprises a DMIT 100 coupled or attached to a disconnect tool 200. Disconnect tool 200 may be connected to a workstring and positioned in a well 60 which has casing 62 fixed in wellbore 64 as shown in FIGS. 3A-3E. An annulus 70 is defined by and between workstring 230 and downhole tool 50 and well 60. It is understood that the downhole tool may be utilized in an open hole or cased environment.

The DMIT 100 comprises a body 104 having a body bore 106 and a plurality of radial ports 108 therethrough. Body 104 may have threaded upper end 107 to connect the DMIT to other tools or tubulars. In the embodiment shown body 104 is threadedly connected at a lower end thereof to a nose 110 comprising a nose seat 112. The nose 110 further comprises a nose bore 114 in selective fluid communication with the body bore 106, depending upon whether an obturator is seated against nose seat 112. As used herein, an obturator is a device configured to plug the flow of fluid through the nose 110. For example, the obturator may be a drop ball sized to engage nose seat 112 and plug the flow of fluid through the nose 110.

The body 104 and the nose 110 cooperate to provide a first flow path that allows fluid to pass through the DMIT 100 through the body bore 106 and the nose bore 114. However, when an obturator is successfully introduced into sealing engagement with the nose seat 112, fluid is restricted from flowing downwardly in the above-described first flow path, but instead, fluid introduced into the body bore 106 may pass out of the body bore 106 through the radial ports 108, which can be referred to as a second flow path.

Figure 4:
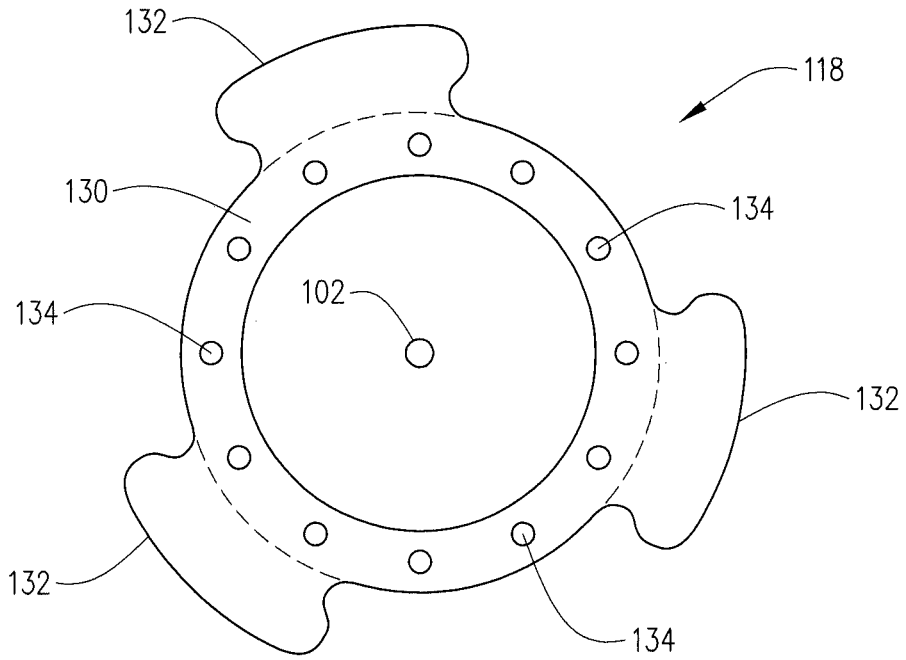
FIG. 4 is a top view of a segment used in a fluid isolator assembly.
Figure 5:
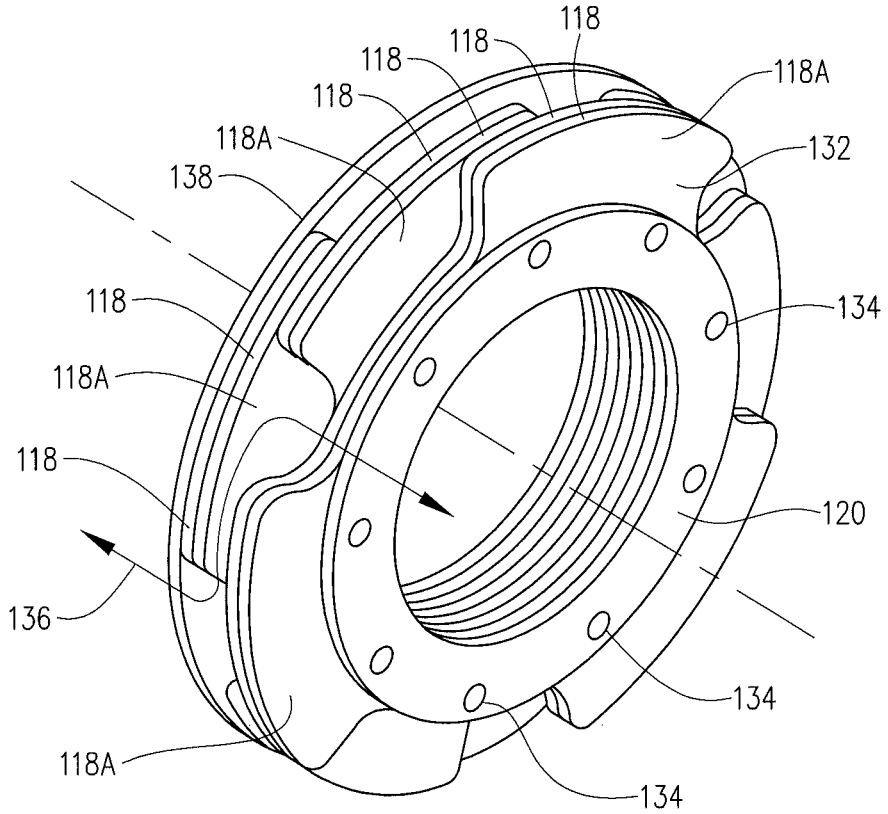
FIG. 5 is a perspective view of a fluid isolator assembly.
Figure 5:
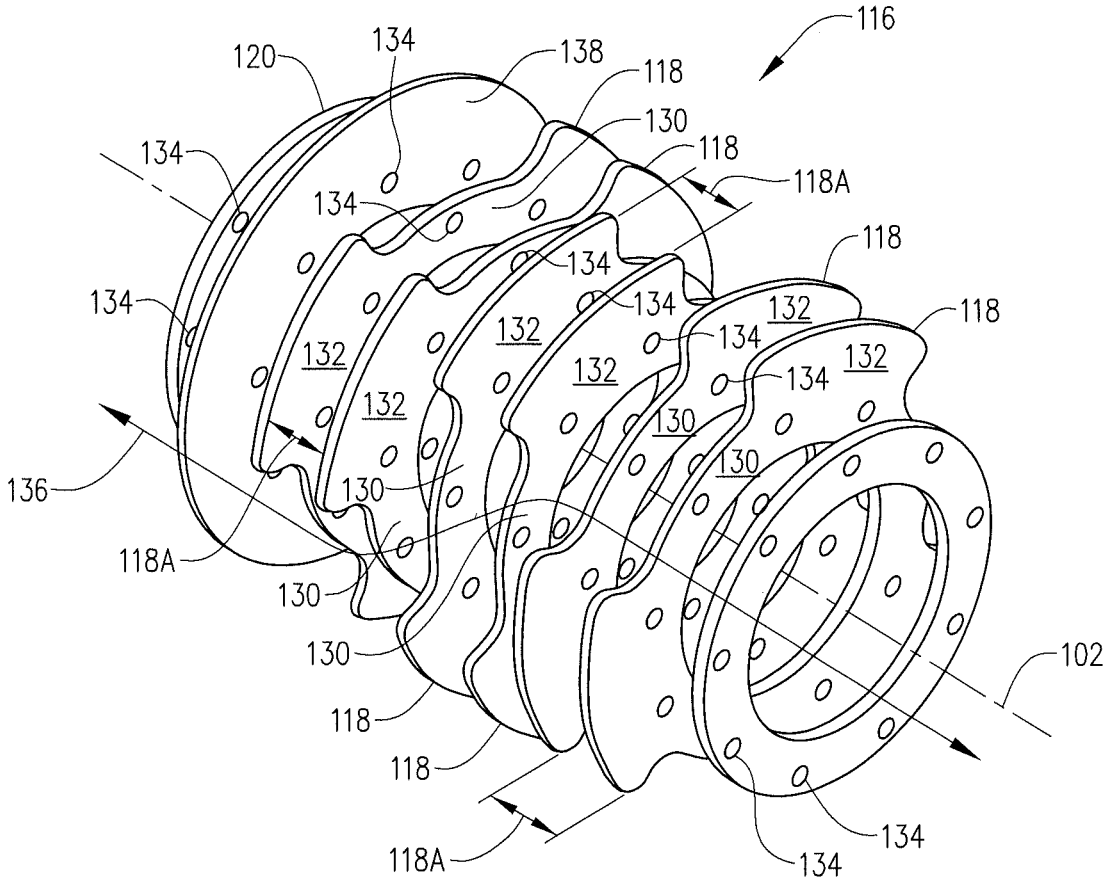

The DMIT 100 also comprises at least one fluid isolator assembly ("FIA") 116, and preferably at least two FIAs 116. The current embodiment shows four FIAs but it is understood that more or fewer than four can be included. The FIA 116 comprises a plurality of generally stacked flexible segments 118 and retainer rings 120. The stacked flexible segments 118 are sandwiched between two retainer rings 120. As shown in FIGS. 4-6, each segment 118 of the FIA 116 is configured to comprise a central ring 130, a plurality of tabs 132 and assembly holes 134. As such, the retainer rings 120 and the segments 118 may be assembled by aligning the rings 120 and segments 118 with each other and angularly rotating the rings 120 and the segments 118 until the assembly holes 134 of the various rings 120 and segments 118 are also aligned.

In the embodiment shown, the FIA 116 comprises six stacked flexible segments 118 and a backstop ring 138. FIG. 4 shows an individual segment, and FIG. 5 shows one arrangement for the flexible segments. In the embodiment shown, each segment 118 has one adjacent segment 118 stacked and aligned therewith to form a pair 118A of stacked aligned segments 118. Each of the three pairs 118A is angularly offset from an adjacent pair 118A. The angular offset will create a fluid flow path, for example flow path 136 therethrough. The backstop ring 138 may be configured as an annular ring having an outer diameter configured to selectively contact the interior wall of well 60. The backstop ring 138 may bend and/or curve in an uphole direction to allow fluid to pass from downhole of the backstop ring 138 to uphole of the backstop ring. While the embodiment described discloses six flexible segments, more or fewer than six can be used.

The backstop ring 138 may be made of a material substantially similar to that of segments 118. It will be appreciated that any of the components of the DMIT 100 may be constructed of materials and/or combinations of materials chosen to achieve desired mechanical properties, such as, but not limited to, stiffness, elasticity, hardness (for example, as related to the possible need to drill out certain components of a DMIT 100), and resistance to wear and/or tearing. In some embodiments, the body 104 and/or nose 110 may comprise fiberglass and/or aluminum, the retainer rings 120 may comprise aluminum, and/or the segments 118 and/or the backstop ring 138 may comprise rubber. Spacers 126 are positioned between the intermediate stacks of flexible segments. The retainer rings 120 on the uppermost stacked flexible segments are captured between an exterior shoulder 122 of the body 104 and a spacer 126. A lock ring 124 engages the exterior of the body 104 below the lowermost retainer ring 120. Most generally, the FIA 116 can be provided with an overall diameter suitable for contacting an interior surface of a wellbore and/or a tubular of a wellbore. The FIA 116 thus may be configured to contact the surface of an uncased wellbore or the interior surface of casing 62 in a wellbore 64.

Figure 2:
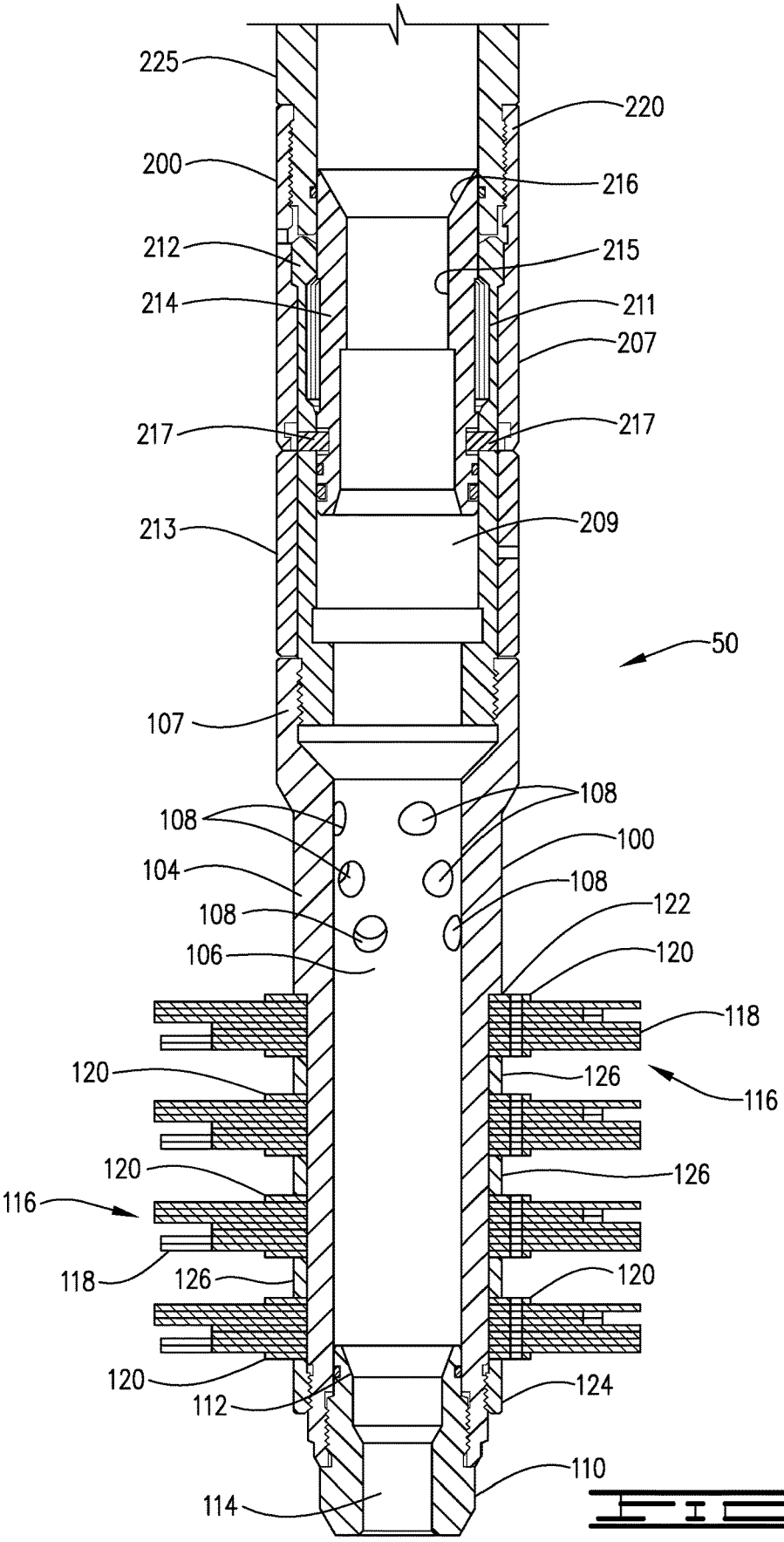
FIG. 2 is a cross-sectional illustration of an embodiment of the disconnect tool and a diversion and movable isolation tool of FIG. 1 connected to a workstring

Disconnect tool 200 may comprise a collet 211 with collet heads 212 at an upper end thereof. FIG. 2 shows body 104 connected directly to collet 211. The disconnect tool 200 may be connected to DMIT 100 with a coupling 205 defining bore 208 therethrough as shown in FIGS. 3A-3E. A collet housing 207 comprises a lower housing 213 and an upper housing 220. A releasing sleeve 214 is detachably connected in collet 211. Releasing sleeve 214 has seat 216 defined at an upper end thereof.

Coupling 205 is connected to the DMIT by, for example, being threadedly connected to body 104 of the DMIT 100 and to collet 211. Coupling 205 is a generally tubular member with bore 208 that is sufficiently large to allow a drop ball 300 configured to engage with the nose 110 to pass therethrough. Collet 211 defines a bore 209 in which releasing sleeve 214 is positioned. Shear pins 217 connect releasing sleeve 214 to collet 211, and although in the embodiment shown coupling 205 connects DMIT 100 to disconnect tool 200, coupling 205 can be removed and the DMIT 100 connected directly to disconnect tool 200 as shown in FIG. 2.

When sufficient force is exerted downward on the releasing sleeve 214, shear pins 217 will break allowing the releasing sleeve 214 to move downward. Collet housing 220 is connected to coupling 225 which is connected to workstring 230 thereabove. When upper collet housing 220 is pulled upwardly, collet housing 220 and the workstring 230 thereabove may be disconnected from DMIT 100.

Figure 3A:
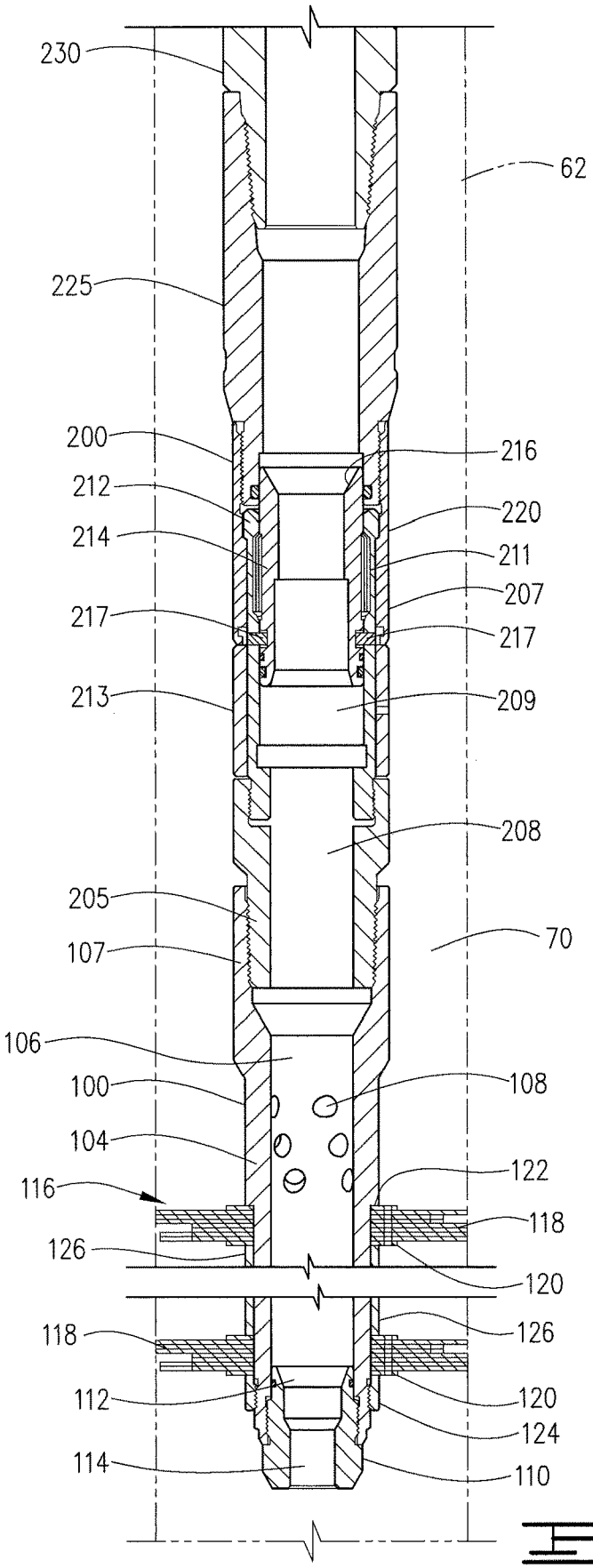
FIG. 3A is a cross-sectional illustration of an embodiment of the disconnect tool and a diversion and movable isolation tool of FIG. 1 connected to a workstring.

Having described the components comprising the DMIT and disconnect tool provided by the present disclosure, the manner in which the disconnect tool operates is described in connection with FIGS. 3A-3E. FIG. 3A depicts the DMIT 100 and disconnect tool 200 in the run-in configuration, which is substantially the same as shown in FIG. 1. In such a configuration, fluid passing through workstring 230 passes through a first flow path, the first flow path being defined by the central passage of the disconnect tool 200 and the DMIT 100. As tool 50 is lowered into the wellbore 60, fluid will pass upwardly through nose bore 114 and out ports 108 into annulus 70. In the run-in configuration, the DMIT 100, and more particularly the FIA 116, will form an at least partial barrier between fluid volumes positioned above the DMIT 100 and fluid volumes positioned below the DMIT 100.

Figure 3B:
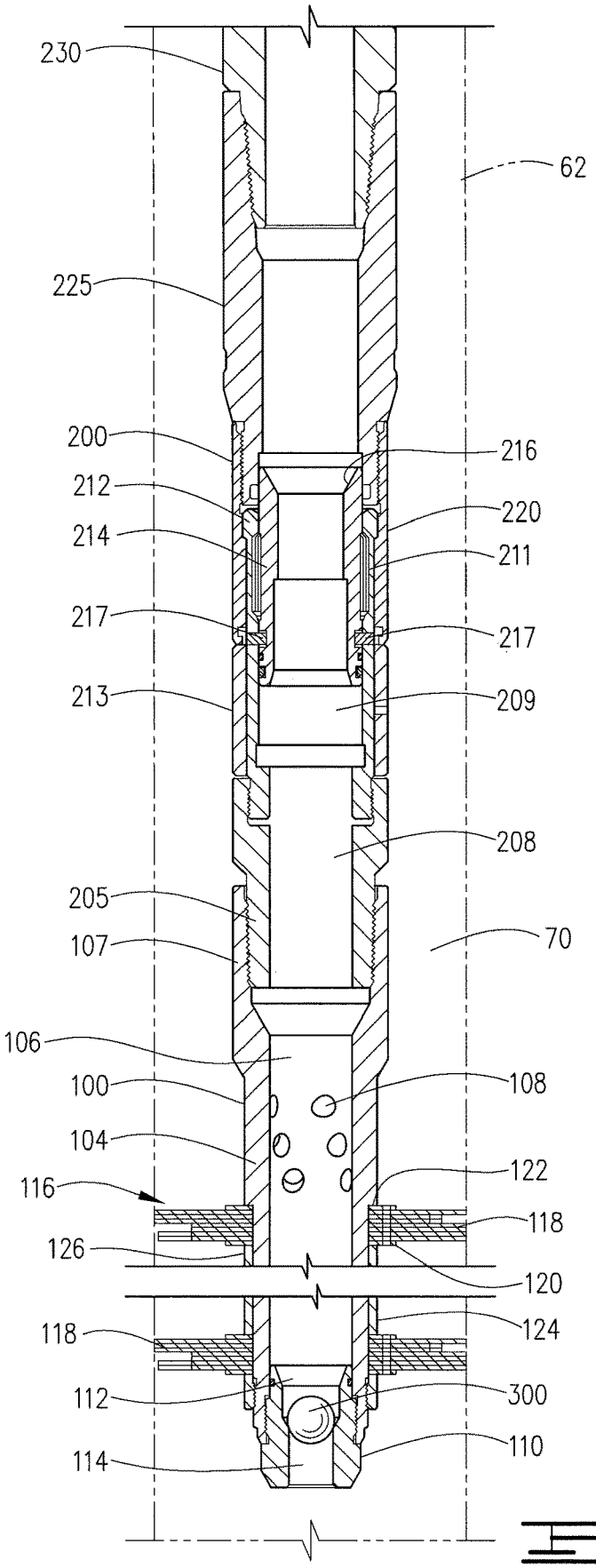
FIG. 3B shows the tool wherein a drop ball has obstructed the nose of the diversion and movable isolation tool.

FIG. 3B depicts the DMIT 100 and disconnect tool 200 after a drop ball 300 has been dropped through workstring 230 to which the DMIT 100 and disconnect tool 200 are attached. The drop ball 300 should be sized so as to be able to pass through the internal diameters of workstring 230, disconnect tool 200 and DMIT 100. Once engaged with the nose 110, the drop ball 300 prevents fluid from passing downward through the DMIT 100 and into the wellbore therebelow. As such, fluid flowing through the DMIT 100 will pass outward through radial ports 108 and upward in annulus 70, also referred to as a second flow path. Fluids used in drilling and completing wells may be delivered through the fluid flow path. For example, water or other fluid used to flush/clean the wellbore may be delivered therethrough.

Figure 3C:
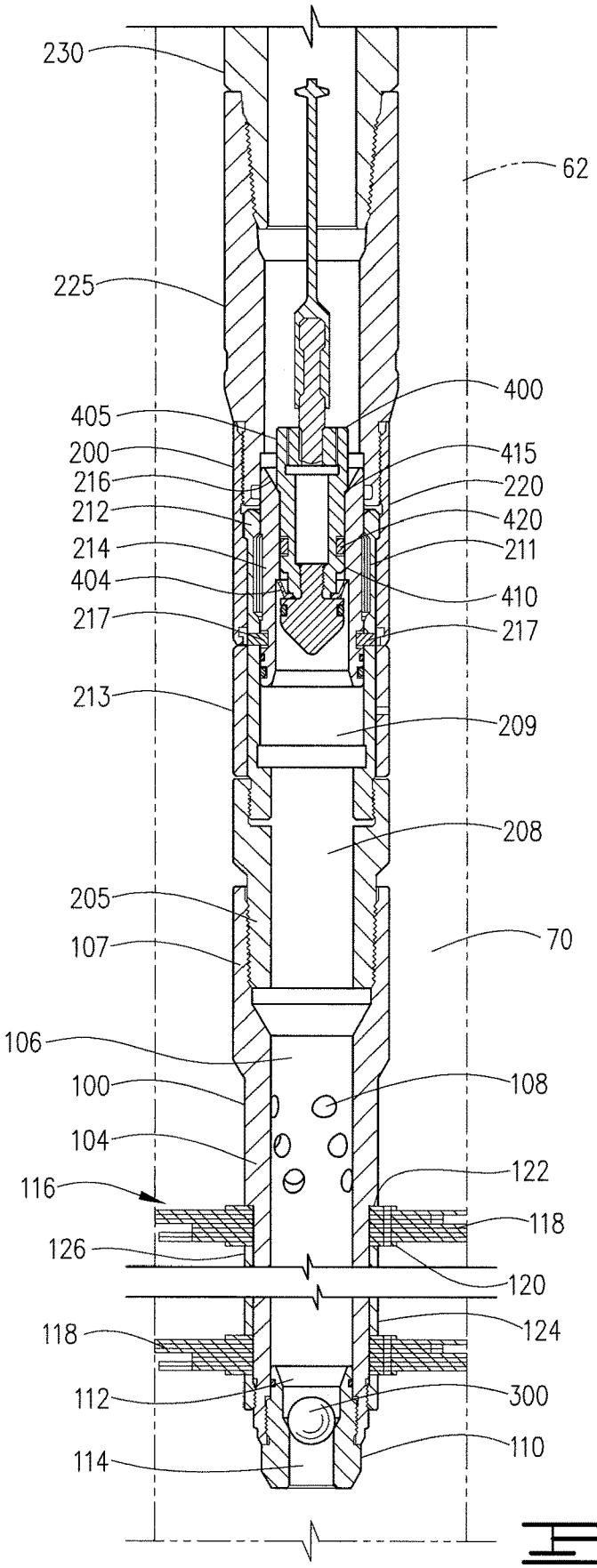
FIG. 3C shows the tool wherein a drop dart has engaged the disconnect tool.

FIG. 3C depicts the DMIT 100 and disconnect tool 200 after a drop dart 400 has been dropped through workstring 230 to which the DMIT 100 and the disconnect tool 200 are attached. The drop dart 400 comprises multiple diameters that cause the drop dart 400 to selectively engage various components of the disconnect tool 200 as the drop dart 400 passes through the workstring and the disconnect tool 200. Specifically, the drop dart 400 comprises first and second dart diameters 405 and 410 defining a shoulder 415 therebetween. Seal 420 will engage the inner surface of releasing sleeve 214, and shoulder 415 will engage seat 216 at the upper end of releasing sleeve 214.

In some embodiments, the drop dart 400 may have wipers 404. Wipers 404 are biased outwardly so as to contact the inner surface of the workstring 230 and disconnect tool 200. Wiper 404 may act to clean the interior of workstring 230 and/or the disconnect tool 200 as the drop dart 400 moves downward. However, because wipers 404 are flexible, wipers 404 will not unduly restrict the downward movement of the drop dart 400.

Figure 3D:
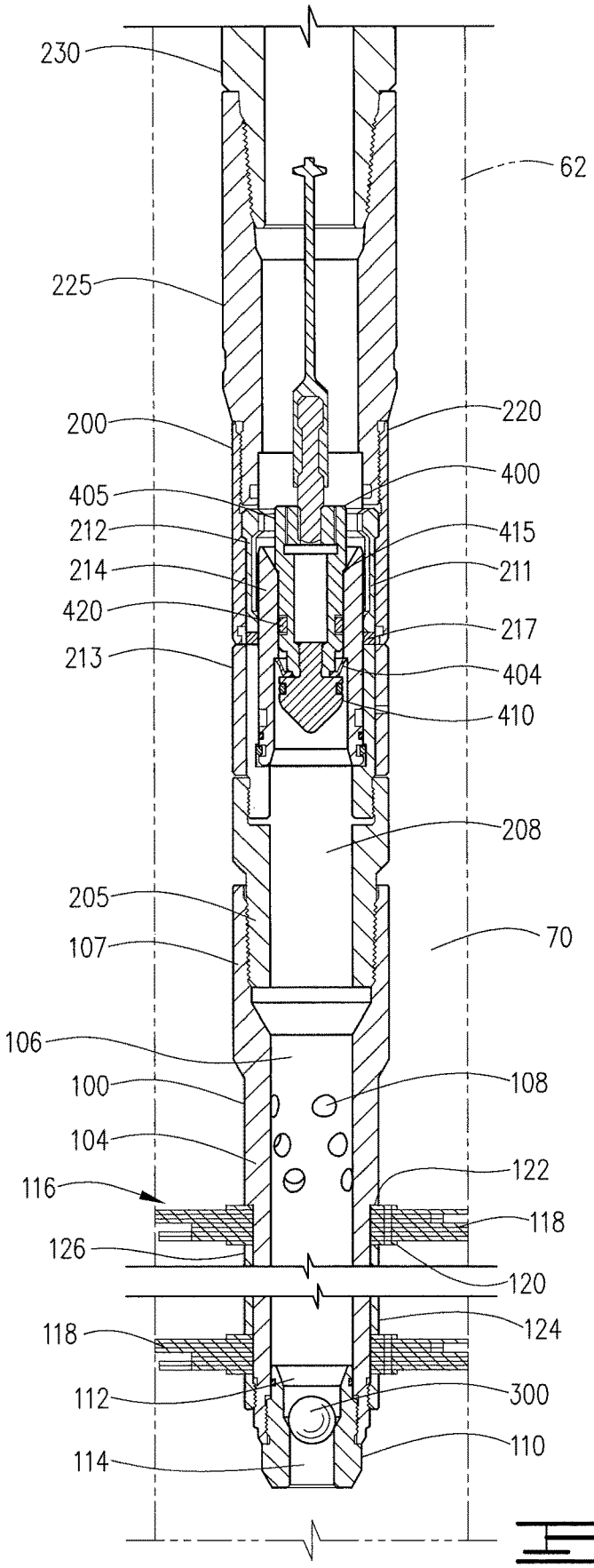
FIG. 3D shows the tool wherein the drop dart has actuated the disconnect tool.
Figure 3E:
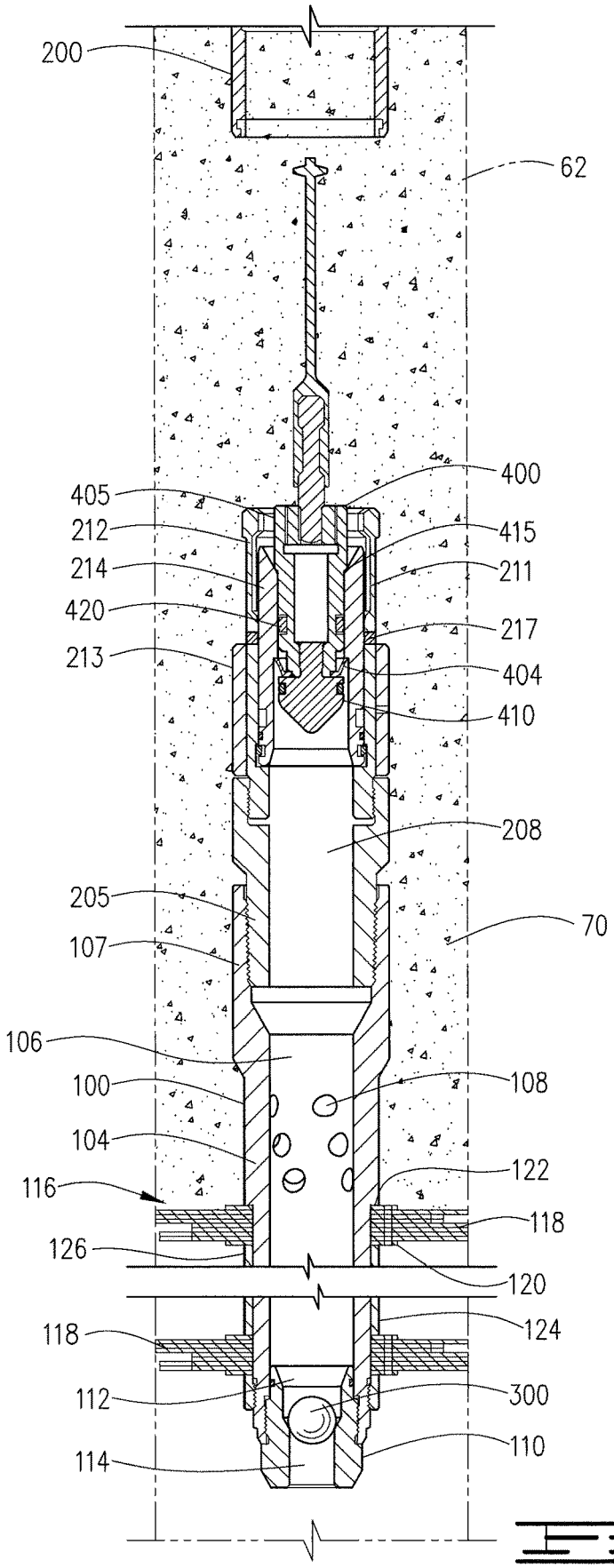
FIG. 3E shows the tool wherein the diversion and movable isolation tool has been disconnected from a workstring.

FIG. 3D depicts the DMIT 100 and disconnect tool 200 after the drop dart 400 has caused shear pins 217 to break. Pressure applied through workstring 230 causes drop dart 400 to push downward on the releasing sleeve 214 thereby causing the shear pin 217 to break. Downward movement of the releasing sleeve 214 will allow collet heads 212 to move inwardly as a result of upward pull on workstring 230. Sufficient upward pull on the disconnect tool 200 with workstring 230 will disengage workstring 230 from the DMIT 100. FIG. 3E shows workstring 230 and upper collet housing 220 pulled upwardly relative to the rest of disconnect tool 200 and the DMIT 100. Having discussed the manner in which the disconnect tool 200 can be separated from workstring 230, the manner in which the DMIT 100 and disconnect tool 200 can be used to create a cement plug in a wellbore is provided.

DMIT 100 and disconnect tool 200 are connected to workstring 230 and lowered into well 60. Well 60 can be in varying stages of completion and can, for example, be cased or uncased. The disclosure herein described uses a cased wellbore. As DMIT 100 is lowered through wellbore 60, any fluid present in the well will be displaced upwardly through the interior of the DMIT 100 and either upward through the workstring 230 or outward through the radial ports 108 and into annulus 70. As DMIT 100 is lowered through wellbore 60 the operator can periodically circulate fluid to ensure that the wellbore is able to circulate, to clear the wellbore, or both.

Once DMIT 100 is placed in the desired location in wellbore 60, drop ball 300 may be dropped through the workstring 230 to engage nose 110 which redirects fluid outward through radial ports 108. Once drop ball 300 has engaged nose 110, fluid can be pumped through the workstring and out the radial ports 108.

Once a desired volume of fluid has been pumped through workstring 230, the drop dart 400 can be dropped through the workstring 230. The drop dart 400 can move through the workstring using the force of gravity or using hydraulic pressure of a fluid pumped behind the drop dart 400. The fluid may be water, or other fluid pumped ahead of cement, or may be the cement to form the cement plug.

Wiper 404 will wipe the inner surface of workstring 230 and disconnect tool 200 as it travels downwardly. Once the drop dart 400 engages the releasing sleeve 214, the disconnect tool 200 can be activated and workstring 230 separated from the disconnect tool 200 and the DMIT 100 in the manner previously described. Once the DMIT 100 and workstring 230 have been separated, cement may be displaced through workstring 230. Workstring 230 may be pulled upwardly simultaneously as cement is displaced therethrough. Once a desired amount of cement has been displaced, fluid may be pumped behind the cement, and the workstring 230 retrieved. The cement plug will be left in the well as shown in FIG. 3E and allowed to set. FIA 116 will help to prevent migration of the cement, so that the plug sets in the proper place in the well. Cement will contact FIA 116 which will act as a barrier between the cement and fluid therebelow. FIA 116 acts as a barrier or membrane across the well to mitigate the effects of gravity on different density fluids. The FIA prevents or minimizes fluid movement due to gravity. The apparatus of the present disclosure will be stable in the well, without the need for a sacrificial tailpipe. The use of two or more FIAs eliminates the need for such a tailpipe, and provides the necessary stability and orientation in the well.

One having skill in the art will appreciate that multiple DMITs, each connected to a disconnect tool 200 could be placed in series along a workstring to thereby form multiple plugs in a wellbore. The upper tool in a series would simply include tool diameters large enough for balls 300 and darts 400 to pass therethrough to the DMIT therebelow.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. Therefore, the particular illustrative embodiments disclosed above may be altered or modified, and all such variations are considered within the scope and spirit of the present invention. Also, the terms in the claims have their plain, ordinary meaning unless otherwise explicitly defined.

What is claimed is:

1. A method of plugging a well comprising:

delivering a diversion and movable isolation tool and disconnect tool to a desired location in the well with the workstring, wherein the diversion and movable isolation tool is connected to the disconnect tool and the disconnect tool is attached to the workstring, wherein the diversion and movable isolation tool has:

a body defining radial ports and a body bore, wherein the body bore defines a flow path between the workstring and an area of the well below the diversion and movable isolation tool; and a fluid isolator assembly, and wherein the fluid isolator engages the well at the desired location so as to act as a barrier in an annulus formed between the body and the well, and wherein the radial ports provide for fluid flow between the body bore and the annulus above the fluid isolator assembly;

plugging the flow path after the step of delivering the diversion and movable isolation tool and disconnect tool to the desired location, wherein the plugging prevents flow through the flow path to the area below the diversion and movable isolation tool but allows flow through the radial ports;

after the step of plugging the flow path, disconnecting the disconnect tool from the workstring by introducing a dart into the disconnect tool, the dart moving a releasing sleeve so as to allow a collet to move thus releasing the disconnect tool from the workstring, wherein the dart prevents flow into the flow path from above the radial ports; and after the step of disconnecting the disconnect tool from the workstring, pumping cement into the well through the workstring above the diversion and movable isolation tool and disconnect tool.

2. The method of claim 1, further comprising pulling the workstring upwardly in the well as cement is pumped therethrough.

3. The method of claim 1, wherein the diversion and movable isolation tool further comprises a nose with a nose bore forming a nose seat configured to engage with an obturator, and wherein the step of plugging the flow path comprises introducing the obturator through the workstring into the diversion and movable isolation tool such that the obturator contacts the nose seat to plug the nose bore.

4. The method of claim 3, further comprising circulating a fluid into an annulus between the workstring and well after the step of plugging the flow path and prior to the step disconnecting the disconnect tool from the workstring, and wherein the fluid is introduced into the annulus through the radial ports.

5. The method of claim 1, wherein the well comprises a wellbore with a casing therein.

6. The method of claim 1, wherein the well comprises an open wellbore.

7. The method of claim 1, wherein the fluid isolator assembly prevents migration of the cement through the annulus.

8. An apparatus for plugging a well, comprising:

a diversion and movable isolation tool comprising:

a body defining radial ports and a body bore, a nose with nose bore forming a nose seat configured to engage with an obturator, wherein the nose bore is in fluid communication with the body bore so as to allow fluid flow through the nose bore between the body bore and area below the nose, and wherein when the obturator is engaged with the nose seat, the fluid flow through the nose bore is prevented and fluid passes out of the body bore through the radial ports, and a fluid isolator assembly which is configured to engage the well so as to act as a barrier in an annulus formed between the body and the well, the fluid isolator assembly is located downward from the radial ports;

a disconnect tool directly connected to the diversion and movable isolation tool, the disconnect tool having a tool bore in fluid flow communication with the body bore, wherein the disconnect tool comprises:

a collet, and a releasing sleeve moveable relative to the collet, wherein the collet and releasing sleeve are configured such that when the releasing sleeve is in a first position, the collet engages a workstring so as to connect the disconnect tool to the workstring, and when the releasing sleeve is in a second position, the collect disengages from the workstring so as to release the workstring, and wherein the releasing sleeve is moved from the first position to the second position by introduction of a dart to the releasing sleeve such that the dart engages the disconnect tool so as to prevent fluid flow through the tool bore into the body bore.

9. The apparatus of claim 8, wherein the fluid isolator assembly comprises a plurality of stacked segments extending from the body and configured to engage the well at a selected location in the well.

10. The apparatus of claim 9, the stacked segments defining a flow path therethrough.

11. The apparatus of claim 8, wherein the dart comprises multiple diameters to selectively engage various components of the disconnect tool.

12. The apparatus of claim 11, wherein the workstring is connected to the diversion and movable isolation tool.

13. The apparatus of claim 8, wherein the dart has outwardly biased wipers so as to contact an inner surface of the workstring, as the dart passes through the workstring.

14. A method of plugging a wellbore comprising:

lowering a diversion and movable isolation tool into the wellbore to a desired location in the wellbore with a workstring, wherein the diversion and movable isolation tool has:

a body defining radial ports and a body bore, wherein the body bore defines a flow path between a workstring and an area of the wellbore below the diversion and movable isolation tool; and a fluid isolator assembly, and wherein the fluid isolator engages the wellbore at the desired location so as to act as a barrier in an annulus formed between the body and the wellbore, and wherein the radial ports provide for fluid flow between the body bore and the annulus above the fluid isolator assembly;

plugging the flow path after the step of lowering the diversion and movable isolation tool to the desired location, wherein the plugging prevents flow through the flow path to the area below the diversion and movable isolation tool but allows flow through the radial ports;

after the step of plugging the flow path, disconnecting the diversion and movable isolation tool from the workstring; and after the step of disconnecting the diversion and movable isolation tool from the workstring, forming a cement plug in the wellbore by displacing cement through the workstring.

15. The method of claim 14, further comprising:

after the step of plugging the flow path, circulating fluid through the workstring prior to the disconnecting step.

16. The method of claim 15, further comprising forming a cement plug in the wellbore at an additional location above the desired location.

17. The method of claim 15, wherein the disconnecting step comprises applying an upward pull to the workstring.

18. The method of claim 14, wherein the diversion and movable isolation tool comprises a disconnect tool having a collet and a releasing sleeve, wherein the releasing sleeve is moveable relative to the collet, wherein the collet and releasing sleeve are configured such that when the releasing sleeve is in a first position, the collet engages a workstring so as to connect the disconnect tool to the workstring, and when the releasing sleeve is in a second position, the collet disengages from the workstring so as to release the workstring, and wherein the releasing sleeve is moved from the first position to the second position by introduction of a dart to the releasing sleeve such that the dart engages the disconnect tool so as to prevent fluid flow through the tool bore into the body bore.

19. The method of claim 18, wherein the fluid isolation assembly engages the wellbore.

20. The method of claim 19, wherein the dart has outwardly biased wipers which contact an inner surface of the workstring as the dart passes through the workstring, and the method further comprising cleaning the inner surface of the workstring by passing the dart through the workstring.

* * * * *